US005623235A

United States Patent [19]

Matloubian et al.

[11] Patent Number: 5,623,235

[45] Date of Patent: Apr. 22, 1997

[54] WIDE-BANDWIDTH VARIABLE ATTENUATOR/MODULATOR USING GIANT MAGNETORISTANCE TECHNOLOGY

[75] Inventors: Mehran Matloubian, Encino; Mark Lui, Thousand Oaks, both of Calif.

[73] Assignee: Hughes Aircraft Company, Los Angeles, Calif.

[21] Appl. No.: 532,062

[22] Filed: Sep. 22, 1995

[51] Int. Cl.[6] ..... H01P 1/23

[52] U.S. Cl. ..... 333/81 A; 29/600; 333/24.2

[58] Field of Search ..... 333/24.1, 24.2, 333/81 A; 29/600

[56] References Cited

U.S. PATENT DOCUMENTS

| | | | |
|---|---|---|---|
| 2,798,207 | 7/1957 | Reggia | 333/81 A |
| 4,272,739 | 6/1981 | Nesses | 333/81 A |
| 4,283,692 | 8/1981 | Adam | 333/81 A X |
| 5,447,781 | 9/1995 | Kano et al. | 360/113 X |

FOREIGN PATENT DOCUMENTS

| | | | |
|---|---|---|---|
| 69001 | 3/1990 | Japan | 333/81 A |

OTHER PUBLICATIONS

"Oscillatory Magnetic Exchange coupling through Thin Copper Layers" *Physical Review Letters,* vol. 66, No. 16, Apr. 22, 1991, S.S.P. Parkin, R. Bhadra and K.P. Roche, pp. 2152–2155.

"Giant magnetoresistance in antiferromagnetic Co/Cu multilayers" *Appl. Phys. Lett.,* 58 (23), Jun. 10, 1991, S.S.P. Parkin, Z.G. Li and D.J. Smith, pp. 2710–2712.

T. Edwards, "*Foundations for Microstrip Circuit Design,*" 1992 Second Edition, John Wiley & Sons, New York, pp. 19–25.

E.H. Fooks, et al., "*Microwave Engineering Using Microstrip Circuits*" 190, Prentice Hall, New York, pp. 40–45 and 233–235.

*Primary Examiner*—Paul Gensler

*Attorney, Agent, or Firm*—V. D. Duraiswamy; W. K. Denson-Low

[57] ABSTRACT

A wide-bandwidth variable attenuator/modulator incorporating a region of material comprising a combination of a ferromagnetic/nonmagnetic material which exhibits a Giant Magnetoresistance (GMR) effect.

24 Claims, 2 Drawing Sheets

WIDE-BANDWIDTH VARIABLE ATTENUATOR/MODULATOR USING GIANT MAGNETORISTANCE TECHNOLOGY

BACKGROUND OF THE INVENTION

1. Field of the Invention

The present invention generally relates to the manufacture of microwave/millimeter wave control devices. More particularly, the present invention relates to a novel variable attenuator/modulator for wide-bandwidth applications.

2. Description of the Related Art

High frequency attenuators/modulators are an integral component in a number of communication and radar systems. Variable attenuators, for example, are widely used in automatic gain control circuits. Presently, PIN diodes are used for variable attenuators/modulators. The bandwidth of a PIN modulator, however, is limited by the capacitance of the diode. PIN modulators are therefore typically limited to a bandwidth of 20 GHz. The microwave power a PIN modulator can handle is also limited by the breakdown voltage of the PIN diode, typically less than a few watts. In addition, it is difficult to monolithically integrate PIN diodes with transistors for circuit applications.

Therefore, there is a need for a wide-bandwidth, high-power variable attenuator/modulator which can be integrated with hybrid and monolithic circuits.

Researchers have reported oscillatory indirect magnetic exchange interaction in nearly-free-electron metals, such as copper. See "Oscillatory Magnetic Exchange Coupling through Thin Copper Layers," by S. S. P. Parkin et al., Phys. Rev. Lett., Vol. 66, No. 16, April 1991. In the Physical Review Letters article, antiferromagnetic coupled Co/Cu superlattices were reported to exhibit extraordinarily large saturation magnetoresistances. Giant values of saturation magnetoresistance in antiferromagnetic Co/Cu multilayers containing thin Co and Cu layers were further reported in "Giant Magnetoresistance in Antiferromagnetic Co/Cu Multilayers," by S. S. P. Parkin et al., in Appl. Phys. Lett., Vol. 58, No. 23, June 1991. The Applied Physics Letters article describes that in the presence of a magnetic field, the resistance of a Cobalt/Copper (Co/Cu) superlattice changes from high resistance to low resistance. Although the article discusses the construction of the superlattice structure and suggests the use of the structure in magnetic field sensor devices, no applications using the structure are disclosed.

SUMMARY OF THE INVENTION

The present invention provides a novel wide-bandwidth microwave/millimeter variable attenuator/modulator using Giant Magnetoresistance (GMR) technology. The GMR effect changes the resistance of a metal superlattice comprised of a ferromagnetic and a nonferromagnetic material when a magnetic field is applied to the superlattice. The resistance of a metal superlattice structure exhibiting the GMR effect changes from a high resistance state to a low resistance state when a magnetic field is applied to the superlattice. The magnetic field required to change the resistance of the superlattice is on the order of 1 to 10 KOe, obtainable from a small magnet.

In the preferred embodiment of the present invention, a Cobalt (Co)/Copper (Cu) GMR superlattice structure is integrated into a microstrip attenuator/modulator. A microstrip attentuator/modulator includes a signal line in the form of a thin metal conductor and also a ground plane which are each bonded to a dielectric substrate. This structure acts as a transmission line. Preferably, the GMR superlattice variable resistor is deposited in the middle portion of the metal conductor and constitutes a variable conducting portion of the signal line. The GMR superlattice can be deposited using conventional low-cost sputtering techniques. Because the Co/Cu superlattice has a high magnetic field sensitivity, the resistance of the superlattice can be changed by applying a magnetic field. As a result, the amplitude of the signal propagating through the attenuator/modulator can be modulated by applying and modulating a magnetic field applied to the Co/Cu superlattice incorporated in the transmission line.

Using the present invention, variable attenuators/modulators can be constructed with a bandwidth up to 100 GHZ. Higher power devices can be produced because devices are no longer limited by the breakdown voltage of the PIN diode. Manufacturing costs can be reduced because the metal superlattice can easily be integrated with hybrid as well as monolithic circuits by a low-cost sputtering process or other deposition techniques well known in the art.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
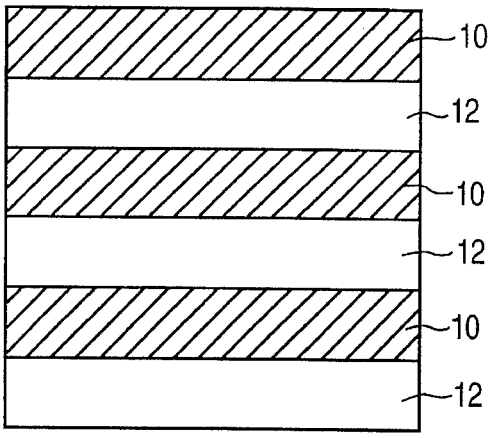
FIG. 1 is a schematic diagram of a cross-section of a GMR superlattice structure.
Figure 3A:
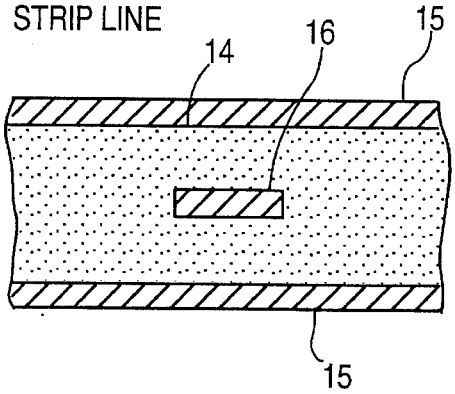
FIG. 3*a* shows a cross-sectional view of a strip line transmission line configuration using the superlattice structure shown in FIG. 1.

As seen in FIG. 1, the most preferred GMR superlattice consists of alternating layers of Cobalt (Co) 10 and Copper (Cu) 12. Fabrication of the superlattice structures can be made by conventional fabrication techniques, for example, sputtering or other deposition techniques well known in the art such as Molecular Beam Epitaxy (MBE). The GMR effect is known in the art to be obtainable from a superlattice with layers as thin as a single angstrom, up to layers over 200 angstroms thick. The GMR effect is also obtainable with superlattice structures including only a single trilayer of ferromagnetic/nonferromagnetic/ferromagnetic materials up to superlattices containing 100 periods (1.5 to 100 bilayers) of alternating layers of ferromagnetic/nonferromagnetic materials.

The GMR effect is also obtainable from a number of different combinations of layered materials or non-layered, crystalline, polycrystalline, and composite materials. Any combination of a ferromagnetic with a nonmagnetic material, such as Fe and Cr, can comprise a superlattice exhibiting the GMR effect. The GMR effect can be obtained with combinations of a ferromagnetic 3*d* transition metal with many nonferromagnetic transition metals such as Co/Ag, Fe/Ag and NiFe/Ag. Preferably, the material is non-ordered having a non-epitaxial, polycrystalline structure. The GMR effect can also be obtained from composite materials consisting of ferromagnetic and nonmagnetic metals. For example, sputtered Cr—Fe heterogeneous alloy films show a large GMR effect.

Depending on the desired performance of the device, superlattices of a wide range of resistances can be constructed accordingly. Preferably, the thickness of a superlattice layer ranges from about a single angstrom to about 200 angstroms for about 1 to about 100 bilayers. More preferably, the thickness of a superlattice layer ranges from about 2 angstroms to about 80 angstroms for about 10 to about 100 bilayers. Most preferably, the magnetoresistance of the superlattice is maximized for thin Co and Cu layers approximately 8–10 angstroms thick for about 60 bilayers.

Figure 2:
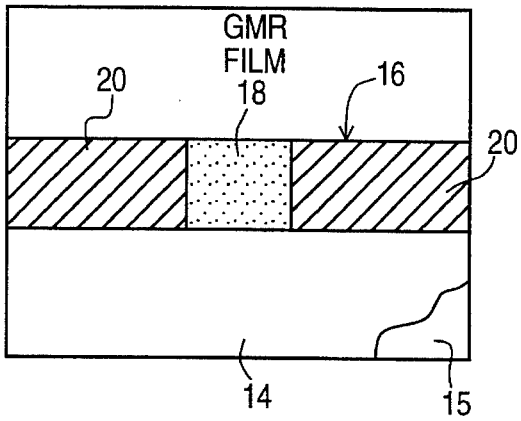
FIG. 2 is a schematic diagram of a wide-bandwidth attenuator/modulator using the structure shown in FIG. 1.

The preferred embodiment of the present invention incorporates the GMR superlattice into a microstrip attenuator/modulator. As shown in FIG. 2, the preferred composite microstrip signal line 16 and associated ground plane 15 can be fabricated onto a substrate 14 using conventional evaporative deposition techniques such as Electron-beam (E-beam). Preferably, the GMR superlattice film 18 is integrated as a portion of the composite signal line 16 through sputtering deposition. Other deposition techniques known for fabricating superlattices, such as molecular beam epitaxy or chemical vapor deposition, may also be used.

The non-variable conducting portion 20 of the composite signal line 16 is preferably comprised of a electrically conductive material with high conductivity, a low temperature coefficient of resistance, low RF resistance and good adhesion to the substrate, as well known in the art. Traditionally metal combinations of Cr/Au, Pd/Au, Ti/Pt/Au or Ta/Au have been used as transmission line 20 conductors.

Figure 3B:
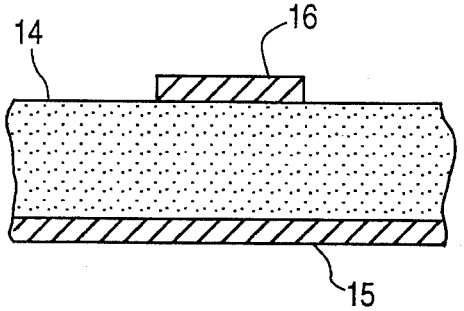
FIG. 3*b* shows a cross-sectional view of a microstrip transmission line configuration using the superlattice structure shown in FIG. 1.
Figure 3C:
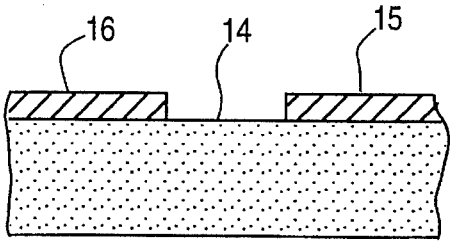
FIG. 3*c* shows a cross-sectional view of a slot line transmission line configuration using the superlattice structure shown in FIG. 1.
Figure 3D:
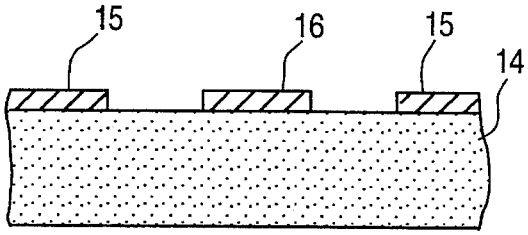
FIG. 3*d* shows a cross-sectional view of a coplanar waveguide transmission line configuration using the superlattice structure shown in FIG. 1.

The preferred embodiment of the present invention uses a microstrip transmission line. The present invention, however, can be incorporated into a wide variety of transmission structure configurations. The particular configuration of the device depends on the intended application, as well known to those skilled in the art. FIGS. 3*a*–3*d* shows some examples of possible planar transmission line configurations such as the strip line (FIG. 3*a*), the microstrip (FIG. 3*b*), the slot line (FIG. 3*c*), and the coplanar waveguide (FIG. 3*d*). In these structures, the GMR superlattice is preferably incorporated into the composite signal line 16 adjacent the dielectric substrate 14 and spaced from ground plane or ground planes 15.

It is well known in the art that the resistance of the superlattice film depends on its total thickness as well as its other physical dimensions. The specific dimensions and configuration of the superlattice film 18, the composite signal line 16, and the dielectric substrate 14 depends on the intended application, as well known to those skilled in the art. Preferably, for high-frequency applications—above approximately 20 GHz—the substrate is one with a high dielectric constant of 4 or more. Gallium Arsenide (GaAs) is well known as one of most suitable substrate materials for microwave and millimeter-wave integrated circuit applications. The most preferred embodiment of the present invention uses a substrate of GaAs/InP/Alumina. A high purity alumina $Al_2O_3$ (99.5%) is also a commonly used substrate material. Other materials with lower dielectric constants such as SiO or $SiO_2$ ($SiO_x$) can also be used, as well known in the art. For lower frequency applications, plastic substrates with a dielectric constant between 2–4 are often used by those skilled in the art.

Through the GMR effect, the amplitude of a signal propagating through the transmission line 16 can be modulated by modulating a magnetic field applied to the GMR superlattice 18. By changing the/resistance of the superlattice 18, the overall resistance of the composite signal line 16 is changed. The amplitude of a signal propagating through the composite signal line 16 can therefore be modulated by modulating the magnetic field applied to the GMR superlattice 18. Because GMR films have a high magnetic sensitivity, only a small magnetic field is necessary to vary the resistance of the superlattice. The magnetic field can therefore be applied to the superlattice, for example, through a permanent magnetic material or an electromagnet of about 1 to 10 KOe, as known in the art.

Figure 4:
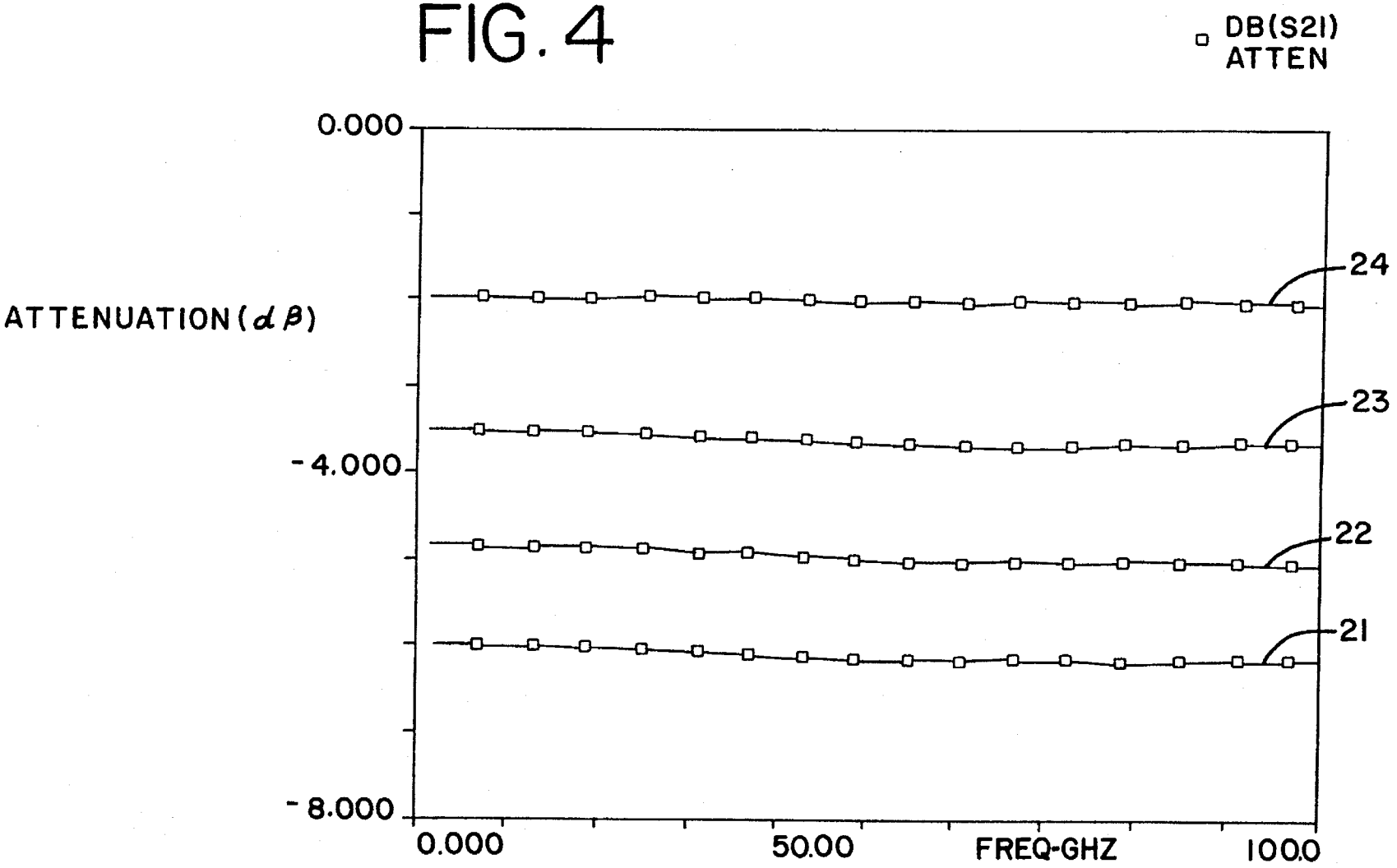
FIG. 4 shows the simulated performance of a preferred variable attenuator using the superlattice structure shown in FIG. 1 at four different magnetic field strengths.

The present invention allows attenuators/modulators to be constructed with a bandwidth up to 100 GHZ. FIG. 4 shows the simulated performance of a variable attenuator using the GMR superlattice film of FIG. 1 over a wide-bandwidth up to 100 GHZ. FIG. 4 shows four attenuation profiles 21, 22, 23, 24 for the device at four different strength magnetic fields. Profile 24 represents the attenuation of the device at a magnetic field strength which is greater than the magnetic field strength of profile 23. Profile 23 represents a greater magnetic field than at profile 22, and so forth until profile 21, which is at the weakest magnetic field. As seen by comparing the four attenuation profiles, the attenuation of the device decreases as the magnetic field is increased.

Accordingly, using the new invention allows higher power devices to be produced because devices are not limited by the breakdown voltage of the PIN diode. Manufacturing costs can also be reduced because the metal superlattice is easily integrated with hybrid as well as monolithic circuits by a low-cost sputtering process or other fabrication techniques well known in the art.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

What is claimed is:

1. A variable attenuator whose attenuation is responsive to a magnetic field, comprising:

planar transmission line having;

a composite signal line which includes;

a) an electrically-conductive portion; and b) a magnetoresistive portion whose resistance is responsive to said magnetic field and which is serially joined with said electrically-conductive portion; and a ground plane spaced from said composite signal line.

2. The variable attenuator of claim 1, wherein said magnetoresistive portion includes:

first and second layers of a ferromagnetic material; and a third layer of a nonmagnetic material positioned between said first and second layers.

3. The variable attenuator of claim 2, wherein said ferromagnetic material comprises cobalt and said nonmagnetic material comprises copper.

4. The variable attentuator of claim 2, wherein said ferromagnetic material comprises iron and said nonmagnetic material comprises chromium.

5. The variable attenuator of claim 2, wherein said ferromagnetic material comprises NiFe and said nonmagnetic material comprises Ag.

6. The variable attenuator of claim 1, wherein said magnetoresistive portion includes alternating layers of a ferromagnetic material and a nonmagnetic material and has a thickness between about 1 angstrom to about 200 angstroms.

7. The variable attenuator of claim 1, wherein said magnetoresistive portion includes alternating layers of a ferromagnetic material and a nonmagnetic material and has a thickness between about 8 angstrom to about 10 angstroms.

8. A variable attenuator whose attenuation is responsive to a magnetic field, comprising:

a dielectric substrate;

at least one ground plane carried by said dielectric substrate; and a composite signal line formed of;

a) an electrically-conductive portion and b) a magnetoresistive portion whose resistance is responsive to said magnetic field and which is serially joined with said electrically-conductive portion;

wherein said composite signal line is carried by said dielectric substrate and spaced from said ground plane to form a planar transmission line.

9. The variable attenuator of claim 8, wherein said magnetoresistive portion includes:

first and second layers of a ferromagnetic material; and a third layer of a nonmagnetic material positioned between said first and second layers.

10. The variable attenuator of claim 9, wherein said ferromagnetic material comprises cobalt and said nonmagnetic material comprises copper.

11. The variable attenuator of claim 9, wherein said ferromagnetic material comprises iron and said nonmagnetic material comprises chromium.

12. The variable attenuator of claim 8, wherein said magnetoresistive portion includes alternating layers of a ferromagnetic material and a nonmagnetic material and has a thickness between about 1 angstrom to about 200 angstroms.

13. The variable attenuator of claim 8, wherein said electrically-conductive portion comprises a combination of chromium and gold.

14. The variable attenuator of claim 8, wherein said substrate comprises gallium arsenide.

15. The variable attenuator of claim 8, wherein said at least one ground plane and said composite signal line are arranged to form a microstrip transmission line.

16. The variable attenuator of claim 8, wherein said at least one ground plane and said composite signal line are arranged to form a strip-line transmission line.

17. The variable attenuator of claim 8, wherein said at least one ground plane and said composite signal line are arranged to form a slot line transmission line.

18. The variable attenuator of claim 8, wherein said at least one ground plane and said composite signal line are arranged to form a coplanar waveguide transmission line.

19. A method of forming a variable attenuator whose attenuation is responsive to a magnetic field, comprising the steps of:

depositing at least one ground plane on a substrate;

depositing a first portion of a composite signal line on said substrate;

forming a second portion of said composite signal line on said substrate so as to be serially joined with said first portion, said forming step including the steps of:

a) depositing first and second layers of a ferromagnetic material; and b) depositing a third layer of a nonmagnetic material positioned between said first and second layers to thereby form, with said first and second layers, said second portion in the form of a magnetoresistive member whose resistance is responsive to said magnetic field; and spacing said composite signal line from said ground plane to form a planar transmission line.

20. The method of claim 19, wherein at least one of said depositing steps includes the step of sputtering materials onto said substrate.

21. The method of claim 19, wherein at least one of said depositing steps includes the step of placing materials onto said substrate with molecular beam epitaxy.

22. The method of claim 19, wherein at least one of said depositing steps includes the step of placing materials onto said substrate with chemical vapor deposition.

23. The method of claim 19, wherein said arranging step includes the step of spacing said composite signal line and said ground plane to form a microstrip transmission line.

24. The method of claim 19, wherein said ferromagnetic material comprises cobalt and said nonmagnetic material comprises copper.

* * * * *